US012259150B2

(12) United States Patent
Al-Khaldi et al.

(10) Patent No.: US 12,259,150 B2
(45) Date of Patent: Mar. 25, 2025

(54) SYSTEMS AND METHODS FOR INTELLIGENT HVAC DISTRIBUTION

(71) Applicant: SAUDI ARABIAN OIL COMPANY, Dhahran (SA)

(72) Inventors: Bader W. Al-Khaldi, Dammam (SA); Fahad S. Al-Khaldi, Khobar (SA); Abdulaziz K. Al-Abdullatef, Khobar (SA); Mazin A. Al-Khudhur, Dhahran (SA); Nawwaf S. Al-Mutiri, Nariyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 375 days.

(21) Appl. No.: 17/809,142

(22) Filed: Jun. 27, 2022

(65) Prior Publication Data

US 2023/0417441 A1 Dec. 28, 2023

(51) Int. Cl.

| | |
|---|---|
| ***F24F 11/63*** | (2018.01) |
| ***F24F 11/74*** | (2018.01) |
| ***F24F 11/80*** | (2018.01) |
| ***F24F 12/00*** | (2006.01) |
| ***F24F 13/10*** | (2006.01) |
| *F24F 110/20* | (2018.01) |
| *F24F 120/10* | (2018.01) |
| *F24F 140/50* | (2018.01) |

(52) U.S. Cl.

CPC ..... *F24F 11/63* (2018.01); *F24F 11/74* (2018.01); *F24F 11/80* (2018.01); *F24F 12/00* (2013.01); *F24F 13/10* (2013.01); *F24F 2110/20* (2018.01); *F24F 2120/10* (2018.01); *F24F 2140/50* (2018.01)

(58) Field of Classification Search

CPC .. F24F 11/63; F24F 11/74; F24F 11/80; F24F 12/00; F24F 13/10; F24F 2110/20; F24F 2120/10; F24F 2140/50

USPC ..... 700/276

See application file for complete search history.

(56) References Cited

U.S. PATENT DOCUMENTS

| | | | |
|---|---|---|---|
| 4,522,116 | A | 6/1985 | Tartaglino |
| 9,345,172 | B2 | 5/2016 | Larsen et al. |
| 11,156,978 | B2 | 10/2021 | Johnson, Jr. et al. |
| 2002/0108386 | A1 | 8/2002 | Spinazzola et al. |
| 2008/0291625 | A1 | 11/2008 | Rathbun, II et al. |

(Continued)

OTHER PUBLICATIONS

Office Action issued in corresponding Saudi Arabian Application No. 123447371, dated Apr. 24, 2024 (6 pages).

*Primary Examiner* — Michael J Brown

(74) *Attorney, Agent, or Firm* — Osha Bergman Watanabe & Burton LLP

(57) ABSTRACT

A system for cooling a plurality of devices of a multi-position rack is provided. The system includes a heating, ventilation, and air conditioning (HVAC) unit configured to generate a flow of cooled air, a plurality of sub-ducts, each sub-duct of the plurality of sub-ducts being configured to direct a portion of the flow of cooled air to a respective device of the plurality of devices in the multi-position rack, and a primary duct configured to direct the flow of cooled air away from the HVAC unit to the plurality of sub-ducts, wherein each sub-duct of the plurality of sub-ducts is sized according to a thermal output corresponding to a respective device of the plurality of devices.

14 Claims, 7 Drawing Sheets

(56) References Cited

U.S. PATENT DOCUMENTS

| | | | | |
|---|---|---|---|---|
| 2014/0065939 | A1* | 3/2014 | Dietz | F24F 11/0001 454/234 |
| 2014/0118924 | A1 | 5/2014 | Magarelli | |
| 2014/0370798 | A1 | 12/2014 | Larsen et al. | |
| 2015/0003010 | A1* | 1/2015 | Kinstle, III | H05K 7/20736 361/679.49 |
| 2015/0264837 | A1 | 9/2015 | Clidaras et al. | |
| 2020/0100394 | A1 | 3/2020 | Albinger et al. | |
| 2020/0318873 | A1 | 10/2020 | Bhosale | |
| 2021/0204447 | A1 | 7/2021 | Yu et al. | |
| 2022/0042417 | A1* | 2/2022 | Arisi | F01D 5/187 |
| 2023/0123181 | A1* | 4/2023 | Shimokawa | F24F 11/63 700/276 |

* cited by examiner

SYSTEMS AND METHODS FOR INTELLIGENT HVAC DISTRIBUTION

BACKGROUND

Heating ventilation and air conditioning HVAC systems provide important services in almost every field and particularly in industrial fields. One of the primary purposes is to maintain certain temperature and humidity points for humans and equipment operated within a space covered by a respective HVAC system.

The demand for HVAC systems has risen sharply in recent years due to the rapid increase of automation and reliance on technologies that facilitate daily lives. Typically, equipment that perform computational work and information-processing require more power and hence additional heat dissipation is desirable. In other words, the more sophisticated the computational system, the higher thermal energy generation becomes.

Many electronics are sensitive to heat and can be impacted or even damaged by excessive temperature (e.g., temperatures exceeding a manufacturer maximum rating) resulting in issues of performance continuity. To avoid such problems, the systems should be cooled continuously and peaks in temperature for given equipment addressed rapidly.

As one example, typical communication facilities (e.g., server rooms, network component rooms, etc.) include equipment, typically mounted in multi-position equipment racks, that generate large amounts of heat resulting in temperature rise without adequate dissipation of the generated heat. The generated heat from all equipment is dissipated based on airflows within the room in which the multi-position rack(s) are located, resulting in increases in the room temperature.

Traditional HVAC systems thus have been configured to supply cooled air to the entire room in which the equipment is located to cool the temperature in the room thereby allowing the equipment to dissipate generated heat. The room air, heated by the equipment is then eventually, based on the air currents within the room, recycled through the HVAC system and re-cooled to be reintroduced to the room once again.

In the communication facilities, the HVAC system is often the largest power consumer, consuming between 60-80% of the total load. Accordingly, there exists a need for optimization and improvement for at least cost savings and environmental reasons (e.g., carbon footprint reduction.)

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a system for cooling a plurality of devices of a multi-position rack is provided. The system includes a heating, ventilation, and air conditioning (HVAC) unit configured to generate a flow of cooled air, a plurality of sub-ducts, each sub-duct of the plurality of sub-ducts being configured to direct a portion of the flow of cooled air to a respective device of the plurality of devices in the multi-position rack, and a primary duct configured to direct the flow of cooled air away from the HVAC unit to the plurality of sub-ducts, wherein each sub-duct of the plurality of sub-ducts is sized according to a thermal output corresponding to a respective device of the plurality of devices.

The thermal output may correspond to a maximal thermal output of a respective device of the plurality of devices.

The system may further include one or more controllable dampers, each of the one or more controllable dampers corresponding to a respective sub-duct of the plurality of sub-ducts, the one or more controllable dampers being configured to control the flow of cooled air.

The system may include a controller configured to monitor operating characteristics of the one or more devices and to control the one or more controllable dampers based on the operating characteristics.

The operating characteristics may comprise one or more of an actual temperature of one or more of the plurality of devices, a fan speed of one or more of the plurality of devices, and an actual power consumption of one or more of the plurality of devices.

The controller may be configured to control the one or more controllable dampers based on a threshold temperature being reached by one or more of the plurality of devices, wherein the threshold temperature is operator configured.

The system may further include a sensor configured to provide information regarding one or more of entry of a human into a space in which the multi-position rack is present and exit of a human from the space, and a secondary cooling duct configured to provide a second portion of cooled air to the space in which the multi-position rack is present in response to entry of the human into the space.

The system may include a controller, and a damper arranged within the secondary cooling duct, wherein the controller is configured to cause the damper to open in response to determining entry of a human into the space.

Each sub-duct of the plurality of sub-ducts may include an outlet sized according to the thermal output of a device of the plurality of devices to which it corresponds.

The HVAC unit may be configured to adjust a temperature of the flow of cooled air based on an overall thermal load.

The system may include a humidity sensor configured to provide information related to an ambient humidity surrounding the multi-position rack, wherein the controller is further configured to control the one or more controllable dampers based on the ambient humidity.

One or more of the plurality of sub-ducts may be movable, and wherein the controller may be configured to cause a movable sub-duct to move in response to a temperature event associated with one or more of the plurality of devices.

The controller may be communicatively linked to a power supply associated with one or more of the plurality of devices, and the controller may be configured to terminate power for one or more of the plurality of devices in response to a temperature event associated with one or more of the plurality of devices.

The controller may be configured to monitor a temperature history of one or more of the plurality of devices and to train a machine learning model based on the temperature history to produce a trained machine learning model.

According to further embodiments of the disclosure, a system for collecting waste heat from a plurality of devices of a multi-position rack is provided. The system includes a plurality of exhaust ducts, each exhaust duct of the plurality of exhaust ducts being configured to receive exhaust air that has been passed over a respective device of the plurality of devices in the multi-position rack, wherein each exhaust duct is sized according to a thermal output corresponding to the respective device, and a collection duct configured to receive exhaust air from each exhaust duct of the plurality of exhaust ducts and to direct the exhaust air to a distribution hub. The distribution hub is configured to control a flow of the exhaust air to one or more of a heat exchanger and an exterior exhaust vent.

The heat exchanger may be configured to provide heated water to one or more of a sanitary hot water system, a heating system, and a power generation system.

The exterior exhaust vent may be located at a position exterior to an enclosed space in which the multi-position rack is located.

The exterior exhaust vent may be configured to provide heat to an inhabited space.

The heat exchanger may include an evaporator of an HVAC unit configured to provide cooled air to the plurality of devices.

Exhaust air provided to the heat exchanger may be returned to an air intake of the HVAC unit.

Other aspects and advantages of the claimed subject matter will be apparent from the following description and the appended claims.

DETAILED DESCRIPTION

Figure 1A:
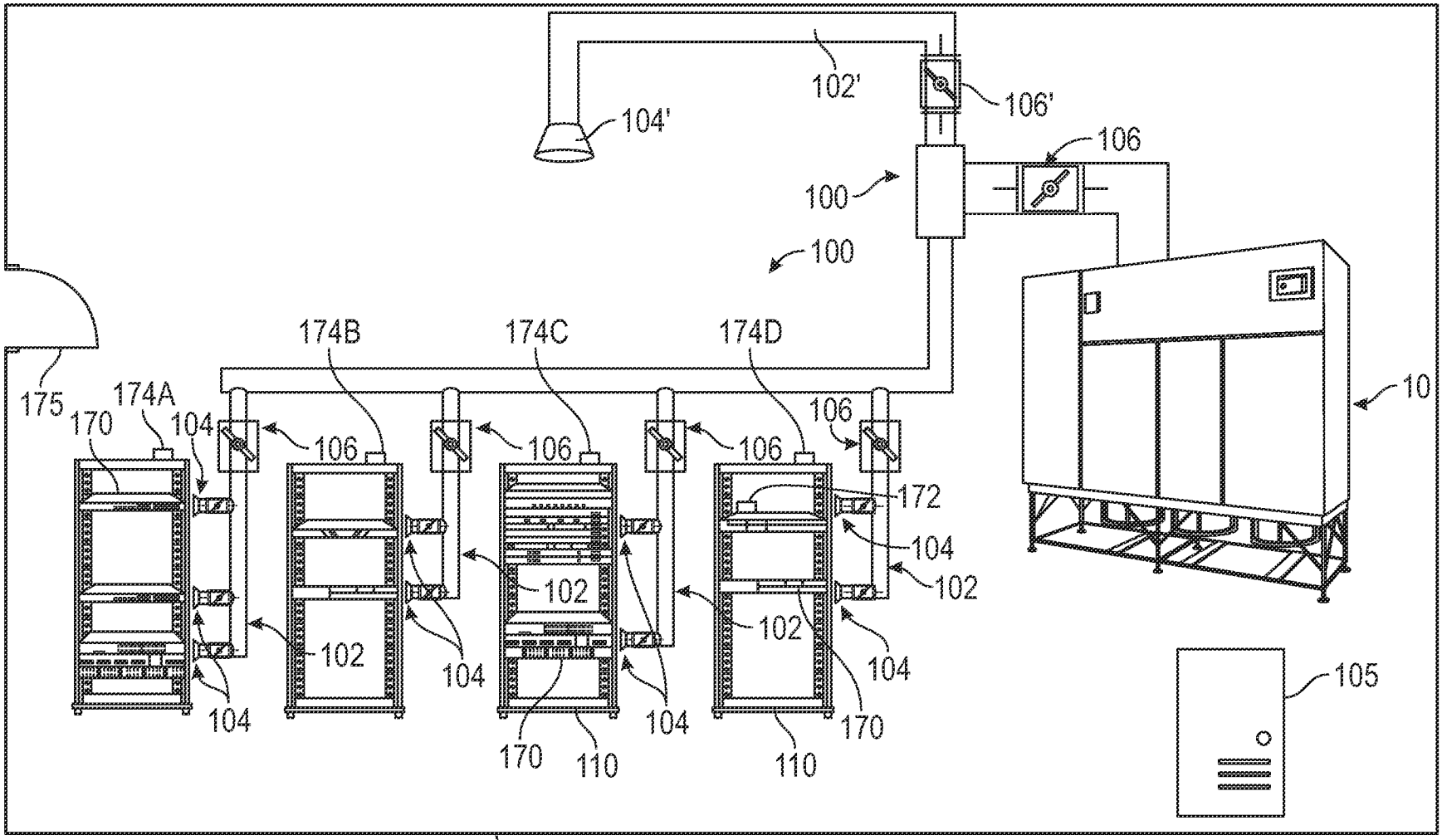
FIG. 1A shows an illustrative intelligent heating, ventilation, and air conditioning (HVAC) system according to embodiments of the present disclosure.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-5, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to a rock sample includes reference to one or more such rock samples.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

The embodiments disclosed herein relate to an intelligent heating, ventilation, and air conditioning (HVAC) system configured to reduce compressor run times in an HVAC unit while maintaining desired temperature levels for equipment located in the space handled by the HVAC system. The disclosed system is configured to direct cooled air to equipment to be cooled by extending conduit directly from the HVAC supply vents to positions in multi-position racks in which the equipment is mounted. In other words, the cooled air flows from the HVAC supply vent to a main supply duct then to sub-ducts in fluid communication with the equipment directly. For example, if there are 5 equipment racks (e.g., server racks), the system may include one main supply duct that branches into 5 sub-ducts, one for each multi-position rack. The ducts (main and sub) are sized according to the amount of heat dissipated by the equipment. Moreover, the air flow can be accordingly distributed to the sub-ducts based on cooling goals for the equipment by implementation and operation of controllable dampers.

By implementing configurations according to the present disclosure, HVAC compressor operation can be reduced thereby reducing power consumption and increasing compressor life. This in turn results in considerable cost savings, improved utilization of the cooling systems, and positive contribution to the environment, for example, by reducing an entity's carbon footprint.

Further, by limiting occurrence of entire-room cooling based on presence or absence of an operator, according to systems and methods of the present disclosure, a more comfortable working environment may be provided for an operator present within the space, while reducing compressor run times when the operator is not present within the space. This may lead to additional energy savings even while providing appropriate working conditions.

Moreover, by disposing of the waste heat according to systems and methods of the present disclosure the HVAC system load may be reduced while also recycling the waste heat for other operations. This may further enhance the energy savings through other third-party systems such as hot water generation and evaporator de-icing.

FIG. 1A shows an illustrative intelligent heating, ventilation, and air conditioning (HVAC) unit 10 for a space 116 according to embodiments of the present disclosure. The HVAC unit 10 is configured to generate a flow of cooled air, a primary duct 100, a plurality of sub-ducts 102, and a controller 105.

The space 116 may correspond to any enclosed or semi-enclosed volume (e.g., a room) in which one or more pieces of powered equipment 170 are intended to operate. For example, the space 116 may correspond to a data center, a server room, a switch room, a telecommunications closet, etc.

The space 116 may include an exit point 254 (see FIG. 2A) for a duct carrying exhaust air to an exterior of the space 116 (e.g., to an outside location). The exit point 254 may comprise, for example, a through-hole in a wall of the space 116 enabling a collection duct 210 to pass therethrough. A seal may be placed around the collection duct and the through-hole to limit and/or prevent exchange of air between the exterior and interior of the space 116.

The space 116 may include one or more points of egress 175, for example, doors, windows, manholes, etc., enabling entry to and exit from the space 116 for an operator. For example, the space 116 may include a door 175 providing sufficient space for comfortable entry and exit of an operator.

The door 175 may be configured with an entry sensor (not shown) enabling determination of entry and exit of an operator through the door 175. The entry sensor may comprise any suitable sensor for detecting entry and/or presence of an operator, e.g., a motion sensor, a magnetic sensor, etc., Two or more sensors may be used in tandem to validate entry of the operator, e.g., a magnetic door open sensor and a light beam sensor.

The door 175 may also be provided with a selective entry mechanism that may grant entry to some operators while refusing entry to other operators. For example, the door 175 may remain locked and unopenable until an operator provides identifying information (e.g., a key, a code, a badge, biometric data, etc.). The selective entry mechanism may then confirm (e.g., via controller 105) that the operator providing the information should be allowed to access to the space 116, and in such a case, unlock the door 175. When the door is unlocked, the controller 105 may assume that an operator has entered the space 116, and appropriate action taken as discussed below.

In addition to sensing and/or determining entry and exit through the door 175, the space 116 may be provided with a surveillance system configured to, for example, monitor temperature of the space 116, detect motion within the space 116, and to report such information to the controller 105. For example, the space 116 may include one or more temperature sensors (not shown) and one or more motion sensors (not shown) positioned around the space 116 and configured to detect temperature and levels of motion consistent with a human operator moving about within the space 116, respectively.

The space 116 may have one or more multi-position racks 110 installed therein, each of the one or more multi-position racks 110 being configured to receive a piece of powered (or unpowered) equipment 170. Distance between the multi-position racks 110 may be configured to allow for components (e.g., sub-ducts 102 of the intelligent cooling system 10 to be installed appropriately as desired.

The multi-position racks 110 may correspond to multi-position racks 110 known in the art and used for mounting and holding equipment 170 in a suitable manner to enable access to and functioning of the installed equipment 170. More particularly, the multi-position racks 110 may enable access to cooling and/or exhaust portions of the equipment 170 installed therein, for example, via front and/or side access.

The number of positions of a multi-position rack 110 may be predetermined and each position indexed and assigned an identifier. Each piece of equipment 170 installed in a location of a multi-position rack 110 may be linked to that position via the identifier and an identifier associated with the installed piece of equipment 170. For example, a database may be maintained at controller 105, in which each piece of installed equipment 170 is linked to a position in a multi-position rack 110 and characteristics of the equipment 170. According to some embodiments, characteristics of the equipment 170 may include an absolute maximum temperature of the equipment, a maximum power consumption of the equipment, an absolute minimum temperature of the equipment, etc. The database may also be configured to store other information, such as, for example, minimum threshold and maximum threshold temperatures for the equipment 170, the threshold temperatures corresponding to triggering temperatures at which cooling may be desirable (maximum threshold) and stopped (minimum threshold). The information may thereby, be linked to the position of the equipment 170 in the multi-position rack 110.

Each piece of equipment 170 installed in one or more positions of a multi-position rack 110 may include temperature measurement means enabling determination of, either explicitly or implicitly, a temperature and/or an amount of heat being generated by a respective piece of equipment 170. For example, an external thermal sensor 172 may be provided for each piece of equipment 170, the thermal sensor 172 being configured to provide an indication of a current temperature and/or a current thermal generation rate of the piece of equipment 170. The thermal sensor 172 may be installed as an aftermarket device for the equipment 170 and may be provided, for example, on or near the equipment 170 within the multi-position rack 110.

As another example, a fan speed of the piece of equipment 170 may be monitored by, for example, a rotational speed sensor provided within the equipment 170. Fan speed can be considered a reasonable indicator for the temperature of a piece of equipment 170, and such fan speeds are typically monitored by a firmware present within the equipment 170 and accessible via an application programming interface API and/or hardware monitor. When the fan accelerates, it can be assumed that the temperature of the equipment 170 is rising and when the fan decelerates, temperature decrease can be assumed (e.g., to a point where the operating temperature is considered normal.)

Another implementation for temperature monitoring for a piece of equipment 170 is measurement of power consumed by the equipment 170. Similar to fan speed, voltage and current are typically monitored by firmware of a piece of equipment 170. Thermal output (Q) being determined by the equation $Q=k(V*I)$ where V is the operating voltage and I is the actual current draw of the equipment 170, and k is a thermal energy conversion constant (e.g., 3.41). When the piece of equipment 170 is consuming its full rated power, it can be assumed that the equipment 170 will generate heat at its maximum manufacturer specified rate, and that an associated temperature increase will occur. If the equipment 170 is consuming, e.g., half of its rated power, it can be assumed that approximately half of the maximum heat is being generated and so on.

One further example of temperature monitoring for equipment 170 can be based on an internal temperature sensor (not shown) included in the equipment 170 by the manufacturer. When provided, internal temperature sensors may be monitored by the firmware of a piece of equipment 170 similar to fan speed, voltage, and current. Using an API or other suitable interface, it may be possible to obtain temperature information from the internal temperature sensor via, e.g., the firmware API.

One or more of the above methods can be implemented to measure an actual temperature of each piece of equipment 170. Accuracy can be enhanced by utilizing two or more of the above methods simultaneously, and this may also enable prediction of an amount of heat that will be generated in the future, e.g., over the next 30 to 60 minutes. For example, the system can use the fan speed and power consumption together to identify the current temperature and predict heat generation. According to such an example, assume that one piece of equipment 170 is operating at an intermediate fan speed (e.g., 50% of a maximum fan speed) but consuming full rated power. Based on the fan speed, it may be assumed that the equipment 170 is momentarily sufficiently cooled, but that its temperature will rise for the next 30 minutes. The controller 105 may take appropriate action to provide desirable cooling for the equipment, e.g., based on a trained machine learning model.

In addition to temperature determination, one or more humidity sensors 174 may be provided to determine a relative humidity for a given location within the space 116. For example, a first humidity sensor 174A may be provided for a first multi-position rack 110. The first humidity sensor 174A may be configured to provide the controller 105 with relative humidity measurements for an area surrounding the first rack 110. Similarly, a second humidity sensor 174B may be provided on a second multi-position rack 110 and configured to provide humidity information for the area surrounding the second rack 110 to the controller 105. Each humidity sensor 174A, 174B, 174C, and 174D may be configured similarly. More or fewer humidity sensors may be provided as desired, based on, for example, a size of the space 116. For example, a single humidity sensor 174 may be provided and configured to provide relative humidity information for the entire space 116.

The controller 105 may combine the received humidity information from the humidity sensors 174A-D along with the thermal load at an associated multi-position rack 110 to determine cooling for the respective multi-position rack 110. For example, if both humidity sensors 174A and 174B indicate that their respective multi-position racks 110 are experiencing low humidity while sensors 174C and 174D are not, the sensors may send information reflecting the situation to the controller 105. The controller 105 may in turn command the HVAC to operate a humidifier (not shown) to increase moisture levels in the main duct 100. Simultaneously, the controller 105 may enable the moisture to flow to the low-humidity, multi-position racks by opening respective dampers 106 while closing the other dampers 106 of the other multi-position racks 110. The dampers 106 of the multi-position racks associated with sensors 174C and 174D might not be fully closed. They might be partially opened to allow few amount of moistures to flow to their multi-position racks if required. Once the humidity level is back-to-normal, the controller 105 may command the HVAC unit 10 to stop the humidifier and the controller 105 may resume normal operation with all multi-position racks and dampers based on their cooling requirements.

Similarly, when humidity levels are detected at above a threshold level at one or more of the humidity sensors 174A-D, the controller 105 may cause a dehumidifier (not shown) to operate and dampers associated with high humidity areas to be fully opened to allow dehumidification.

The HVAC unit 10 may be any suitable device configured to provide a desired amount of cooled air. For example, the HVAC unit 10 may comprise a chiller and/or an air conditioning unit. The HVAC unit 10 may be configured to provide sufficient cool air to handle a maximum thermal load of all equipment 170 installed within the space 116.

A thermal load for the HVAC unit 10 may be determined by a desired operating temperature for the equipment 170 and a maximum heat generation rate associated with the equipment 170. For example, where the space 116 is intended to comprise equipment 170 that is determined to have a maximum heat generation rate of 40000 KJ/hour (corresponding to approximately 35 servers), an HVAC unit capable of generating cooling capacity of 40000 KJ/hour may be implemented. A factor of safety may be applied to the cooling capacity, for example, ranging between 1.1 and 1.3 (e.g., 1.2), and an HVAC unit capable of generating cooling capacity of between 44000 KJ/hour and 52000 KJ/hour may be implemented. The values for cooling capacity and factor of safety are illustrative and are not intended to be limiting.

Figure 1B:
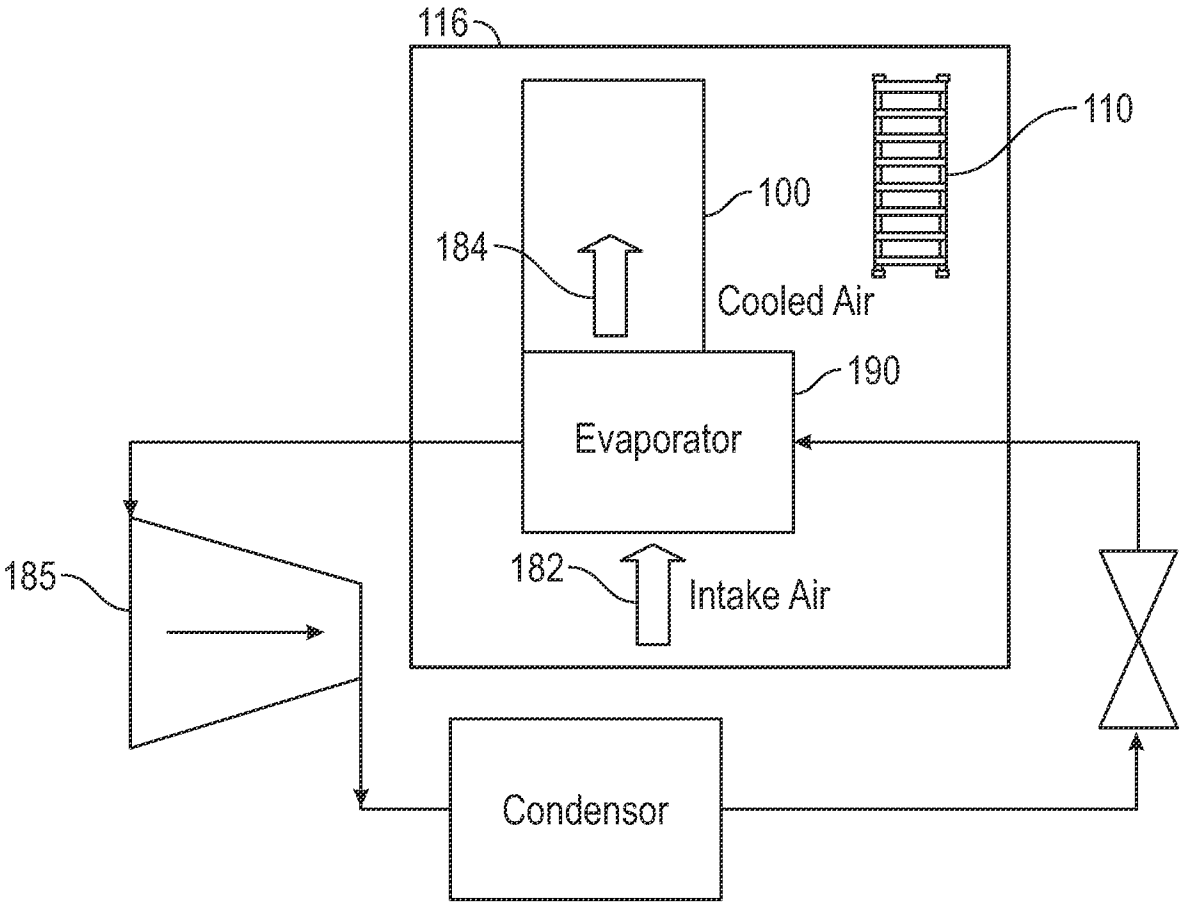
FIG. 1B is a schematic of an illustrative refrigeration circuit and select components of embodiments of the disclosure.

FIG. 1B is a schematic of an illustrative refrigeration circuit and select components according to some embodiments of the present disclosure. The HVAC unit 10 may operate on a refrigeration thermal cycle and may comprise, for example, a controllable compressor 185 and an evaporator 190, among other things. The HVAC unit 10 may be configured to receive an intake fluid (e.g., air) 182, provide the intake air to a heat exchanger (e.g., evaporator 190) of the HVAC unit 10 to remove thermal energy from the intake fluid 182, and produce a flow of cooled air 184 using, for example, a fan (not shown) or other entrainment device. According to some embodiments, some components of the HVAC unit 10 may be located within the space 116 (e.g., the evaporator 190) while other components (e.g., the controllable compressor 185), a condenser, etc. may be located outside the space 116. Other implementations of an HVAC unit 10 may also be used without departing from the scope of the present disclosure.

The HVAC unit 10 may include a communications interface (not shown) enabling information to be sent and received by the HVAC unit 10. For example, the HVAC unit 10 may be capable of receiving commands regarding operation of the compressor 185, the fan, etc. via wired or wireless connection. Such commands may be provided by the controller 105 in response to, for example, operating conditions associated with the equipment 170 within the space 110, as well as ambient conditions within the space 116 (e.g., when an operator is present within the space 116.)

The HVAC unit 10 may be configured to vary its operating characteristics (e.g., in response to commands from the controller 105), and thereby, characteristics of the cooled air 184 according to an actual or anticipated thermal load associated with the equipment 170 within the space 116. For example, when a thermal load associated with the equipment 170 is low and associated temperatures of the equipment 170 remain within a normal range, the compressor 185 of HVAC unit 10 may be turned off and the HVAC unit 10 idled. During such idle period, intake air 182 may continue to circulate through the evaporator 190 to the primary duct 100 to provide the equipment with unconditioned airflow. When the thermal load and/or temperatures associated with one or more pieces of equipment 170 increase the compressor 185 may be switched on to produce cooled air 184 to be directed via the primary duct 100.

The primary duct 100 is fluidly connected with an outlet of the HVAC unit 10 and configured to direct the flow of cooled air 184 generated by the HVAC unit 10 away from the HVAC unit 10. For example, the primary duct 100 may be configured to direct the flow of cooled air to the plurality of sub-ducts 102.

The primary duct may be sized according to a maximal thermal output corresponding to the equipment 170 to be cooled by the flow of cool air passing through the primary duct 100 and according to jurisdictional standards. For example, ductwork may follow the standards such as Saudi Arabian Mechanical Codes SBC-501 and SAES-K-100 as published as of the priority date of the present application. As an example, where the maximum thermal output of all equipment in all racks is 40,000 KJ/hour, then the main supply duct is sized to supply at least 48,000 KJ/hour, with an optional factor of safety (e.g., 1.2) applied.

The primary duct 100 may be fabricated from any suitable material for carrying cooled air from the HVAC unit 10 to the sub-ducts 102. For example, the primary duct 100 may be fabricated from plastic, metal, composites, etc., and combinations thereof. According to some embodiments the primary duct 100 may be fabricated from a composite material having low thermal conductivity and good leakage resistance and sealability. This may enable the primary duct 100 to reduce losses through heat conduction and leakage. Materials may comprise, for example, galvanized steel, aluminum, and fiberboard.

While the present disclosure discusses a single primary duct 100, according to some embodiments it may be desirable to connect multiple primary ducts 100 to an HVAC unit 10. This may be the case where, for example, two distinct spaces 116 are configured with equipment 170 to be cooled, and where it is desirable to utilize a single HVAC unit 10 (e.g., for cost savings.) Conversely, it may be desirable to implement a plurality of HVAC units 10 to feed a single primary duct 100. For example, where space limitations or other constraints render it desirable to split the HVAC load among different HVAC units 10, these units may all feed the primary duct 100 to provide cooling.

Returning to FIG. 1A, the primary duct 100 may include one or more controllable dampers 106 configured to adjust (i.e., increase/decrease) a flow of air through the primary duct 100. According to some embodiments, the controllable dampers 106 may comprise a flap sized to substantially seal a duct in which it is located when in a closed position, and one or more actuators (e.g., servo motors) configured to open and close (e.g., via rotation) the controllable damper 106 in response to, for example, a signal from the controller 105.

The controllable dampers 106 may be configured to be closed or open corresponding to, for example, 0 degrees and 90 degrees of rotation, thereby prohibiting (when closed) and fully allowing (when fully open) airflow, respectively, through the primary duct 100. The fully open and fully closed positions need not correspond to 0 and 90 degrees respectively, and other suitable angles may be implemented without departing from the scope of the present disclosure. For example, a fully closed position may correspond to 20 degrees of rotation while a fully open position may correspond to 70 degrees of rotation.

Further, the controllable dampers 106 may be configured to enable varying amounts of opening by adjustment of an opening angle thereof. For example, an actuator (e.g., a servo motor) may be provided to enable a controllable damper 106 to be rotated within certain angle increments such as, for example, 2 degrees, 4 degrees, 6 degrees, etc. The controller 105 may thereby command the opening/closing of a controllable damper by increment (e.g., 1, 2, 3). The mentioned angle increments are intended as illustrative only and any suitable increment may be implemented as desired.

The controllable dampers may be communicatively connected to the controller 105 via, for example, wired and/or wireless connections. For example, each actuator associated with a controllable damper 106 may be provided with a wireless network communication interface that may be connected directly or indirectly to the controller 105. Any suitable wireless connection may be implemented, for example, Wi-Fi 802.11 (a/b/g/n/ac), 4G, 5G, etc. Alternatively, or in addition, a wired connection may be provided, for example, Ethernet (RJ45), USB (A/B/C), serial (RS232), etc.

Each of the controllable dampers 106 may be provided with an identifier that may be stored in a database (e.g., by controller 105) along with information linking the controllable damper 106 with a location in the space 116 (e.g., relative to the primary duct 100 or sub-duct 102) and a multi-position rack 110 being served by the controllable damper 106. For example, a controllable damper 106 serving a first multi-position rack 110 may be provided with an identifier such that when it becomes desirable to provide more airflow to equipment 170 in the first multi-position rack 110, the controller 105 may address commands to the appropriate controllable damper 106 using the controllable damper's identifier.

According to embodiments of the disclosure, a plurality of sub-ducts 102 are provided and configured to carry cooled air 184 from the primary duct 100 to equipment 170 in a multi-position rack 110 within the space 116. Each sub-duct may be fabricated from similar materials and in a similar manner to the primary duct 100. Alternatively, as desired, each sub-duct 102 may be fabricated from a different material than another sub-duct 102, for example, to provide greater flexibility in directing the flow of cooled air to a multi-position rack 110 depending on, for example, geometrical and space constraints.

Each sub-duct 102 can be extended to a multi-position rack 110 such that each multi-position rack 110 has one or more designated sub-ducts. For example, each multi-position rack may be allocated one sub-duct 102 for purposes of providing a flow of cooled air. According to some embodiments, a multi-position rack 110 may be provided with 2 or more sub-ducts 102 depending on a desired configuration for cooling the equipment 170 in the multi-position rack 110 and other heat transfer considerations (e.g., anticipated future load).

Each sub-duct 102 can be sized according to a thermal load associated with the equipment 170 in the multi-position rack 110 the sub-duct 102 is intended to cool. For example, where a multi-position rack 110 includes equipment generating 10000 KJ/hour (25% of the thermal load for the space 116 discussed above), the size for such a sub-duct 102 can be configured to be 25% of the primary duct 100. Similarly, where a multi-position rack includes equipment generating 20000 KJ/hour (50% of the thermal load for space 116 discussed above) the size for such a sub-duct 102 can be configured to be 50% of the primary duct 100. When considering sizing of a sub-duct 102 the hydraulic diameter of the sub-duct 102 may be the measure by which such sizing is determined.

According to some embodiments, additional size margin may be applied to sizing of the primary duct 100 and/or the sub-ducts 102 such that future expansion and changing operational demands be taken into account. For example, a 20% additional size margin can be applied for each of the sub-ducts 102.

According to some embodiments, one or more of the primary duct(s) 100 and the sub-ducts 102 may be insulated to reduce energy loss via heat transfer with the space 116. For example, the primary duct 100 may be wrapped with a polyurethane foam material having a low heat transfer coefficient (e.g., between about 0.022 and 0.035 W/m·K). Similarly, one or more of the plurality of sub-ducts 102 may be wrapped in a similar material to that used for the primary duct 100. Alternatively, each duct may be insulated in using different materials than another duct, based on, for example, a thermal load intended to be handled by the respective duct. In other words, improved insulation may be provided to a sub-duct 102 intended to cool a multi-position rack 110 having a higher thermal load than another multi-position rack 110.

Each sub-duct 102 may include one or more controllable dampers 106. The controllable dampers 106 may be configured such that when a temperature associated with one or more of the pieces of equipment 170 is increasing, the controller 105 may cause the controllable damper 106 to adjust an opening angle to allow greater air flow through the respective sub-duct 102. Conversely, when temperatures associated with the equipment 170 are or return to normal, the controller 105 may cause the controllable damper 106 may be adjusted to reduce the air flow through the respective sub-duct 102. Corresponding adjustments to one or more controllable dampers 106 associated with the primary duct 100 may also be made based on the adjustments to the controllable dampers of a sub-duct 102.

Each sub-duct 102 may include one or more outlets 104 configured to allow a portion of the flow of cooled air to reach a respective piece of equipment 170 within the multi-position rack 110 served by a respective sub-duct 102. For example, where a multi-position rack 110 includes 4 pieces of equipment 170 a sub-duct 102 serving the rack 110 may include 4 outlets 104, each corresponding to a piece of equipment 104 within the rack.

Each outlet 104 may be sized according to a piece of equipment 170 for which it is designated and the designated cooling capacity of an associated sub-duct 102. For example, taking the example mentioned above (40000 KJ/hr total thermal load), assuming that the first multi-position rack 110 includes equipment generating 20000 KJ/hour then, the size of the sub-duct of the first multi-position rack may be 50% of the primary duct 100. Assuming that the first piece of equipment 170 in the first multi-position rack is generating 10000 KJ/hour then, its respective outlet size may be 50% of the sub-duct which is 25% of the primary duct, and so on.

Each outlet 104 may include a controllable damper 106 configured to adjust airflow through the outlet 104. For example, a controllable damper 106 may be provided directly adjacent to an outflow point of an outlet 104 and may be configurable between a fully open and a fully closed position (e.g., via rotation). A controllable damper 106 associated with an outlet 104 may be automatically adjusted via, for example, a servo motor in communication with the controller 105, and may be adjusted in response to a temperature of an associated piece of equipment 170, among other things. Identifiers for each controllable damper associated with an outlet may also be stored at controller 105 similar to those for the primary and sub-ducts.

Each outlet 104 may be positioned near an air intake of a respective piece of equipment 170 (i.e., where the equipment 170 is configured to receive external air for cooling). For example, an outlet 104 may be configured such that an airflow coming from the outlet 104 passes directly into an air intake of a respective piece of equipment 170. A shape for such an outlet 104 may be designed in a complementary manner to the air intake of the respective piece of equipment 170, for example, to minimize leakage and maximize air transfer.

Alternatively, or in addition, one or more outlets 104 may be movable relative to the multi-position rack 110 which it serves. For example, one or more outlets 104 may be mounted on slidable rails or similar feature associated with a sub-duct 102 and enabling the outlet 104 to slide up and down along the vertical height of a multi-position rack. In such embodiments, the sub-duct 102 may be open on one side (i.e., where the sliding outlet 104 is provided) and a flexible sealing material positioned thereon to allow the sub-duct 102 to be sealed where the movable outlet 104 is not present.

According to further embodiments, a flexible sub-duct that is movable may be provided. In such a case, the outlet 104 may not move itself, but the flexible and movable sub-duct 102 can move upwards and downwards while the outlet 104 is fixed on the sub-duct 102. The movable sub-duct will direct the outlet 104 to the desired equipment 170.

The moveable outlet 104 may be moved (e.g., automatically using a servo motor or other driving device) in response to, for example, a determined temperature of equipment 170 in the multi-position rack with which the moveable outlet 104 is associated. For example, when controller 105 determines that a piece of equipment 170 at a first position of a multi-position rack 110 is approaching or has exceeded a maximum temperature the controller 105 may cause the moveable outlet 104 to be moved to the first, first position of the multi-position rack 110 and to open an associated controllable damper 106 fully.

A space cooling sub-duct 102' may be provided within space 116 for purposes of providing a flow of cooled air to the space 116. For example, the space cooling sub-duct 102' may include a controllable damper 106' and an outlet 104' configured to cooperate to permit and prohibit airflow into the space 116 from the primary duct 100 and/or a sub-duct 102.

The space cooling sub-duct 102' may be designed and sized to cool down the space 116. For example, standards in place for determining room cooling requirements may be used for sizing of the space cooling sub-duct 102' and related components.

Cooling of the space 116 via the space cooling sub-duct 102' may be triggered either manually or automatically. For example, upon detection of an operator passing into the space 116 via the door 175 (e.g., based on a motion and/or door open sensor) to provide an improved working environment for the operator.

According to further embodiments, an operator may provide the system with an anticipated arrival time to the space 116. For example, an operator may schedule, via an interface made available by controller 105 or other suitable device, a time to perform work in the space 116 (e.g., server maintenance). The controller 105 may then cause the controllable damper 106' to open in advance of the scheduled arrival time of the operator to enable the space 116 to reach a desirable temperature prior to arrival of the operator. In order to determine an estimated cooling time for the space 116, the controller 105 may use current operating information from the equipment 170 (e.g., current thermal load, etc.) as well as past information related to cooling times to determine when to begin cooling the space 116 in advance of the operator's arrival.

Operator scheduling may be linked to a corporate travel system, for example, the corporate travel system logging travel requests and purpose for travel throughout a company. Therefore, when an operator requests travel via the corporate travel system, for example, to perform maintenance on a server located in the space 116, the corporate travel system may automatically update the controller 105 with the information for the operator's intended travel/work schedule, such that controller 105 may take appropriate action to cool the space 116 for the operator's work therein.

Confirmation of the operator's presence within the space 116 may be achieved via, for example, ID verification for entry to the space 116 (e.g., via an employee badge), motion detection from the sensors in the space 116, etc. In the absence of confirmation of presence, the controller 105 may notify an appropriate entity to request that a space cooling operation be cancelled, for example, or may even cancel the space cooling operation.

According to some embodiments, machine learning may be implemented using one or more models to determine the estimated cooling times based on the thermal load and the actual temperature within the space 116. For example, the system can utilize a supervised learning (ML) model to provide a proper environment for the operators. The inputs of the ML model can include the operator entry and departure times along with the actual temperature within the space 116, (and optionally ambient conditions outside the space, e.g., ambient temperature and humidity) while an expected output of the ML model is time to reach a desired temperature in space 116 (e.g., 20° C.). For example, if the system notices that the operator enters the site every Monday at 8:00 am, it may operate controllable damper 106' (along with the compressor if it is off) earlier so that at 8:00 am the space 116 temperature is 20° C. The time it operates the compressor 185 and controllable damper 106' may depend on the actual temperature within the space 116. For example, if space 116 temperature is 24° C., they will operate at 7:45 am based on previous events, such that at 8:00 am the space 116 temperature will reach 20° C. If an actual temperature of space 116 is 28° C., the cooling may be started at 7:30 am based on past data showing cooling time for an 8 degree differential of 30 minutes.

According to still further embodiments, an operator may manually actuate the controllable damper 106' to enable cooled air to flow into the space 116. For example, a lever or other mechanical actuator may be provided allowing an operator to open a controllable damper 106'. Further, where operated manually, the controllable damper 106' may automatically close after a predetermined time that may be configured in the controller 105. For example, if an operator operates the controllable damper 106' manually and then forgets to close the controllable damper 106' after work has been completed, the controllable damper 106' will automatically close after, for example, 3 hours from the time it was opened. This may prevent wasted cooling when an operator is no longer present in the space 116.

Figure 2A:
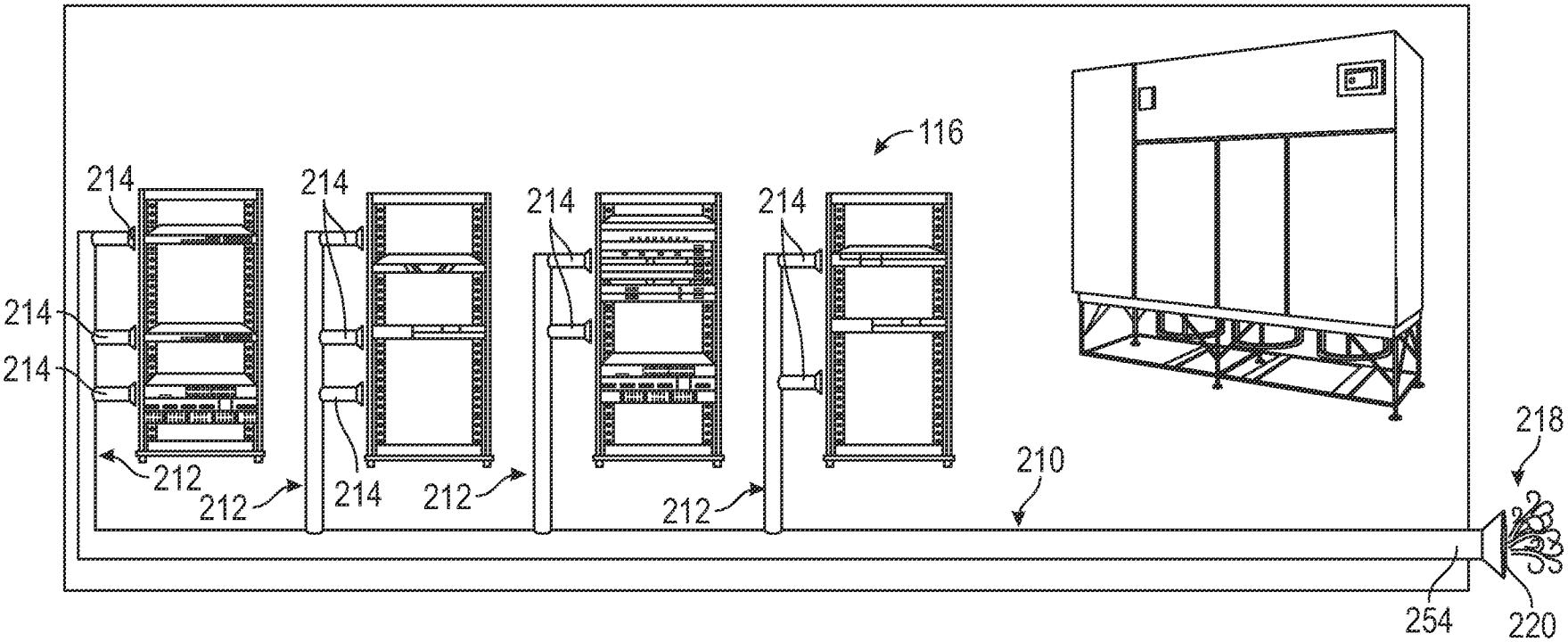
FIG. 2A shows an illustrative exhaust air collection system according to embodiments of the present disclosure.

According to one or more embodiments of the disclosure, waste heat in exhaust air from the equipment 170 may be collected by a waste heat collection system for processing and/or exhausting. FIG. 2A shows an illustrative exhaust air collection system 200 according to embodiments of the present disclosure. Such a system may include a plurality of inlets 214 feeding respective exhaust ducts 212, a collection duct 210, and an exterior exhaust vent 220. According to some embodiments, a distribution hub 250 may also be provided (shown at FIG. 2B).

An exhaust duct 212 may be configured to receive exhaust air that has been passed over a respective piece of equipment 170 located in a multi-position rack 110. Each exhaust duct 212 may be fabricated from similar materials and in a similar manner to the primary duct 100 and/or the sub-ducts 102. Alternatively, as desired, each exhaust duct 212 may be fabricated from a different material, for example, to reduce cost.

Each exhaust duct 212 can be located to a multi-position rack 110 such that each multi-position rack 110 has one or more designated exhaust ducts 212. For example, each multi-position rack may be allocated one exhaust duct 212 per piece of equipment 170 installed in the multi-position rack 110, for purposes of collecting exhaust air comprising waste heat collected from equipment 170 in the multi-position rack 110.

Each exhaust duct 212 can be sized according to an anticipated air flow associated with the equipment 170 in the multi-position rack 110 being cooled by air flow form a sub-duct 102. For example, the size of exhaust duct 212 may be equal to a size of a corresponding sub-duct 102 providing cooled air to the multi-position rack 110, which in turn may correspond to a thermal output of the equipment 170 in the multi-position rack 110.

Each exhaust duct 212 may be positioned on an outlet side of the equipment 170 in the multi-position rack 110 (e.g., where the equipment 170 exhausts the heated air) and may be provided with an inlet 214 corresponding to an outlet of a single piece of equipment 170. For example, an inlet 214 may be configured such that an airflow coming from the outlet of a piece of equipment 170 passes directly into the respective inlet 214. In this regard an inlet 214 may be designed in a complementary manner to the outlet of the equipment 170, for example, to minimize leakage.

Exhaust ducts 212 may be fluidly connected to the collection duct 210, the collection duct 210 being configured to collect the exhaust air and thereby the waste heat, and to direct the exhaust air to a distribution hub 250 or other suitable location (e.g., a location exterior to the space 116). The collection duct 210 may be fabricated from similar material and in a similar manner to the primary duct 100, and may be insulated similarly to the primary duct 100 and/or the sub-ducts 102.

The collection duct 210 may be configured to direct the exhaust air directly to an exterior location 218 via an exterior exhaust vent 220. As used herein, the term "exterior" is intended to mean a location outside of and isolated from the space 116 in which the multi-position racks 110 are located. The exterior may correspond, for example, to an outdoor space outside of a building in which space 116 is located.

Figure 2B:
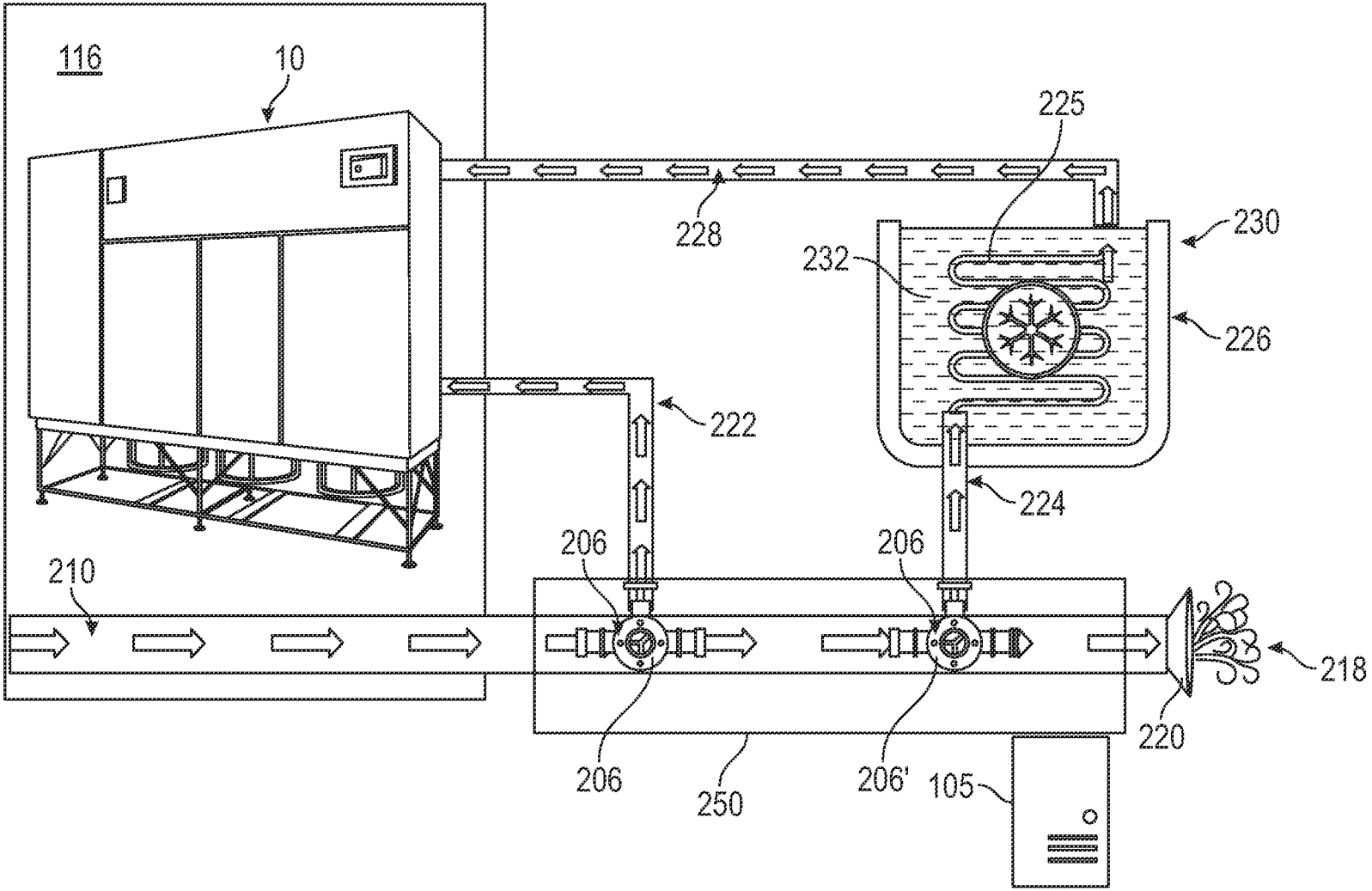
FIG. 2B shows an illustrative waste heat utilization system according to embodiments of the present disclosure.

Alternatively, the collection duct 210 may be configured to direct the exhaust air to a distribution hub 250. FIG. 2B shows an illustrative waste heat utilization system including a distribution hub 250, according to embodiments of the present disclosure. The system may further include a heat exchanger 225, among other things.

According to some embodiments, the collection duct 210 may operate passively to direct the exhaust gas to the distribution hub 250 and/or the exterior 218. In other words, no additional energy, mechanical or otherwise, may be imparted to the exhaust air flowing in the collection duct 210, and the exhaust air may flow based on entry of exhaust air into the inlets 214.

Alternatively, one or more devices to impart energy to the flow of exhaust air in the collection duct 210. For example, one or more fans (not shown) may be provided to induce the exhaust air to flow to move through the collection duct 210 to the exterior 218 and/or the distribution hub 250.

The distribution hub 250 may be configured to control at least a portion of the flow of exhaust air such that the exhaust air is directed to one or more of the evaporator 190, a heat exchanger 225, and the exterior location 218. For example, the distribution hub 250 may include one or more valves or vanes 206 configured to redirect at least a portion of the exhaust air flowing in the collection duct 210. In such an example, a first valve 206 may be fluidly connected to an evaporator duct 222 configured to carry at least a portion of the exhaust air to the evaporator 190 of the HVAC unit 10.

Alternatively, or in addition, a second valve 206' may be provided between the p collection duct 210 and a heating duct 224 supplying a heat exchanger 225 of a supplemental heating system 230 such that at least a portion of the exhaust air may be directed to the supplemental heating heat exchanger 225. For example, the supplemental heating system 230 may comprise a container 226 containing a fluid 232 (e.g., liquid water, air, etc.). The supplemental heating heat exchanger 225 may be immersed in the liquid 232 within the container 226. More or fewer valves 206 leading to more or fewer waste heat recycling devices may be implemented within one or more distribution hubs 250 without departing from the scope of the present disclosure.

According to some embodiments, the supplemental heating system 230 may comprise, for example, a pre-heat stage for a sanitary water heating system, among other things. In such a configuration, the container 226 may comprise a pressure vessel and the water 232 may be provided by a typical water supply (e.g., "city water"). Once the water 232 has absorbed heat via the heat exchanger 225, it may be passed to a water heater of the sanitary water heating system or depending on a temperature increase of the water 232, used directly upon exiting the container 226.

According to some embodiments, the supplemental heating system 230 may comprise, for example, a heating system for a separate HVAC system configured to provide heat to, for example, a living space (not shown) inhabited by humans.

According to still further embodiments, the supplemental heating system 230 may be primarily configured to re-cool the exhaust air by placing the container 226 outside and open to the external atmosphere. According to such embodiments, the liquid 232 (e.g., water) in the container 226 may act as a heat sync configured to absorb the waste heat rapidly and then subsequently release the heat to the atmosphere over time.

A cooled air duct 228 configured to direct the air exiting the heat exchanger 225 may be provided. The cooled air duct 228 may be fluidly connected, for example, to the air intake of the HVAC unit 10. The exhaust air, cooled in the heat exchanger 225 may thereby be reintroduced to the HVAC unit 10 as cooled air. This may in turn enable reduction in compressor run times as well as greater energy efficiency for the system.

Figure 3:
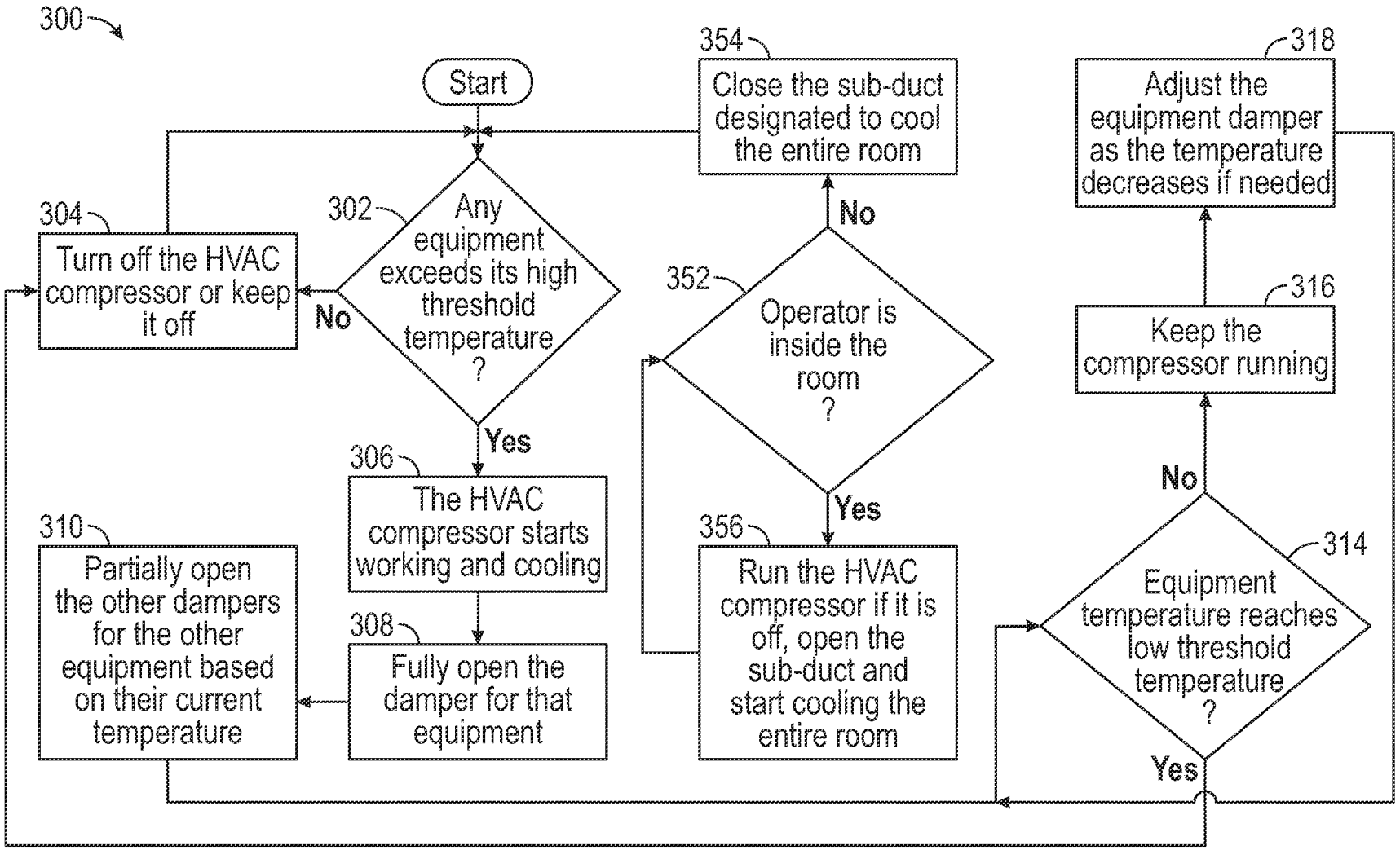
FIG. 3 is a flowchart highlighting an illustrative method for operating the HVAC system of FIG. 1A.

FIG. 3 is a flowchart (300) highlighting an illustrative method for operating the HVAC system of FIG. 1A. For purposes of discussing the method of FIG. 3, the follow non-limiting example will be used: a space 116 includes a multi-position rack 110 having 3 pieces of equipment 170: Equipment A, equipment B, and equipment C with respective operating temperature ranges of 0-40° C., 0-50° C., and 0-60° C. (0° C. is the absolute minimum temperature while 40° C., 50° C. and, 60° C. are the respective absolute maximum temperatures). According to embodiments of the present disclosure, minimum and maximum threshold temperatures for each piece of equipment 170 may be configurable by an operator. For purposes of the present non-limiting example, a low temperature threshold is set to 10° C. while a high temperature threshold is set to 30° C. for all 3 pieces of equipment.

According to some embodiments, steps 302 and 352 may operate simultaneously as "monitoring" steps for the method 300. In other words, steps 302 and 352 may operate in parallel as "OR" entry points to the control method illustrated at FIG. 1A, such that upon either condition being determined as true, the corresponding steps may be carried out. Thus, at step 302 the temperature for each piece of equipment 170 within the space 116 may be monitored (e.g., by controller 105) to determine whether any of the pieces of equipment are exceeding or nearly exceeding the set high threshold temperature (step 302) for the respective piece of equipment 170. Monitoring of equipment temperature may be performed via any suitable method, for example, using dedicated temperature sensors assigned to each piece of equipment 170. When it is determined that all equipment within space 116 is operating within defined temperature ranges for respective equipment (step 302: No), the controller 105 may cause the compressor 185 of the HVAC unit 10 to stop operating (when currently operating) or to remain stopped/dormant (step 304).

When one or more pieces of equipment 170 are determined to be either near or exceeding the set high threshold temperature for a respective piece of equipment 170 (step 302: Yes), the controller 105 may cause the compressor 185 to begin operating to cause HVAC unit 10 to cool air flowing through the evaporator 190 (step 306). For example, the controller 105 may send a wireless command to the HVAC unit 10 to indicate that cooled air should be produced. The cooled air may be directed into the primary duct 100 to be carried to the respective sub-ducts 102.

One or more controllable dampers 106 controlling air flow through the primary duct 100 and the sub-duct 102 to the equipment 170 that is exceeding its threshold high temperature may be fully opened to permit a desirable level of cooling for the equipment 170 (step 308). Similarly, the controllable dampers 106 associated with other equipment 170 not exceeding respective threshold high temperatures may be partially opened according to actual operating temperatures of the respective equipment 170 (step 310), determined according to the above-described techniques.

The controller 105 may continue monitoring the temperature of all equipment 170 in the space 116 (step 314), and as long as temperatures remain above the threshold minimum temperatures (step 314: No) operation of the compressor 185 may be maintained (step 316).

As one or more pieces of equipment 170 reach a respective minimum threshold temperature, in the present example, 10° C., controllable dampers 106 controlling airflow associated with such equipment 170 may be adjusted and/or closed (step 318), for example, to prevent the equipment from falling below the minimum threshold temperature and to allow airflow to be allocated elsewhere to bring other equipment temperatures down to the minimum threshold (step 318).

When the equipment temperatures for all the pieces of equipment 170 in the space 116 have reached the low threshold temperature (step 314: Yes) the compressor 185 may be shutdown (step 304) or put into dormant mode and the temperatures monitored (step 302) once again.

According to the above, and using the information from the example noted above, assume that equipment A has a current temperature of 27° C., equipment B of 20° C. and, equipment C of 15° C., in this case, the compressor 185 may be off and all controllable dampers 106 may be closed. Assume then that equipment A reaches 30° C., equipment B reaches 23° C., and equipment C reaches 18° C. Step 302 reaches a Yes decision, and the compressor 185 will be commanded by the controller 105 to operate and to fully open (step 308) the controllable damper 106 associated with equipment A. Because the compressor 185 is operating and equipment B and C are below the high temperature threshold of 30° C., controllable dampers 106 associated with equipment B and C may be partially opened (e.g., percent) (step 310) until equipment B and C reach the low temperature threshold (10° C.). The controllable dampers for equipment B and C may then be closed. As for equipment A, the controllable damper 106 may remain fully open and the compressor 185 continues to operate (step 316) until equipment A reaches 10° C. The compressor 185 may then be turned off (step 304) until one or more of the equipment reaches 30° C. again.

Operation of respective controllable dampers 106 (i.e., those managing airflow for a particular piece of equipment 170) may be based on cooling requirements of the associated equipment requirements. For example, if equipment A is approaching its high threshold temperature, the controllable dampers 106 of the primary duct 100 and the controllable dampers 106 of the associated sub-duct 102 may be adjusted accordingly. Further, a controllable damper 106 managing airflow through an outlet 104 may also be fully opened to allow maximum airflow to pass in order to decrease the temperature of the subject equipment 170. A maximum air flow to the equipment is subjected to the size of the outlet 104, which is configured relative to size of the associated sub-duct 102 and the piece of equipment 170 being served by the outlet 104. According to some embodiments, when a temperature of equipment A reaches an intermediate level (e.g., halfway between the high threshold and the low threshold, the controllable damper 106 of the outlet 104 may be adjusted to be halfway open to allow part of the cooled air to pass to other equipment (e.g., equipment B.) This may allow more air to flow to other equipment that may be experiencing higher temperatures. When equipment B is already at the low threshold or within a predetermined percentage thereof (e.g., 10 percent), the controllable outlet damper for equipment A may remain full opened until equipment A is fully cooled to the low threshold temperature. For each case, the controllable dampers 106 of the primary duct 100 and associated sub ducts 102 can be adjusted accordingly.

The system may be configured to store information related to cooling of the equipment 170 as well as the space 116. Machine learning models (e.g., Markov models, hidden Markov models, decision trees, neural networks, etc.) may be implemented to further optimize power consumption of the HVAC unit 10. In the present example, the system may calculate the time that equipment A took to go from 30° C. to 10° C. and utilize this information for training the model, thereby benefiting future equipment cooling. For example, if equipment A took 30 minutes to go from 30° C. to 10° C. while its damper is fully open, the next time equipment A reaches 30° C., the system may try to adjust the controllable dampers 106 managing airflow to equipment B and C such that after 30 minutes this equipment will also be at 10° C. This approach may result in all 3 pieces of equipment reaching the low temperature threshold (10° C.) at approximately the same time, thereby allowing earlier shut down of the compressor.

According to some embodiments, if equipment A exceeds the designated high threshold temperature (e.g., 30° C.) and remains below its absolute high temperature (40° C.), the system may give equipment A high priority for cooling to reduce the temperature as soon as possible. An alert may be sent to an operator that equipment A has exceeded its threshold temperature through via an alarm system (e.g., associated with controller 105).

When a piece of equipment exceeds its absolute maximum temperature (e.g., another alert may be sent to the operator that equipment A has exceeded the absolute high temperature requesting immediate intervention.

As noted above, the space 116 may be continuously monitored to determine whether an operator is entering or has entered the space 116, and whether the operator remains therein (step 352). While there is no operator within the space 116 (step 352: No) the controllable damper 106' associated with the space cooling sub duct 102' may be closed such that no cooled air is provided by the HVAC unit 10 to the space 116 via the space cooling sub-duct 102'.

When an operator is detected to be entering, or to have entered the space 116, (step 352: Yes), the controller 105 may cause the compressor 185 to begin operation (if it is shut down) and to open the controllable damper 106' associated with the space cooling sub duct 102' so that cooled air is provided to the space 116 via the space cooling sub duct 102' (step 356). For example, an operator may scan a badge to gain entry to the space 116, and upon authorization to enter the space 116 by, e.g., controller 105, the controller may send a command to operate the compressor 185 and to open the controllable damper 106' associated with the space cooling sub duct 102'. The space 116 may be cooled in this manner until the system detects that operator has left the space or until a predetermined threshold temperature is reached within the space 116 (e.g., 20° C.). The compressor 185 may then be shut down, except where equipment cooling indicates otherwise, as discussed above. Steps 302 and 352 may then be continually performed until a temperature change or operator status occurs.

Alternatively, or in addition to monitoring the space 116 for present of an operator, as described above, an operator may schedule a date and time when the operator intends to enter the space 116. For example, an operator may indicate an intended entry date and time 3 days and 2 hours in advance of arrival (i.e., entry). In such a case, the controller 105 may determine a time to begin "pre-cooling" the space 116 by operating the compressor 185 and opening the controllable damper 106' associated with the space cooling sub duct 102'. According to some embodiments, the controller 105 may implement machine learning to determine an optimal time to begin the pre-cooling, the determination being based on, for example, current thermal load within the space 116, past cool-down time, etc.

Figure 4:
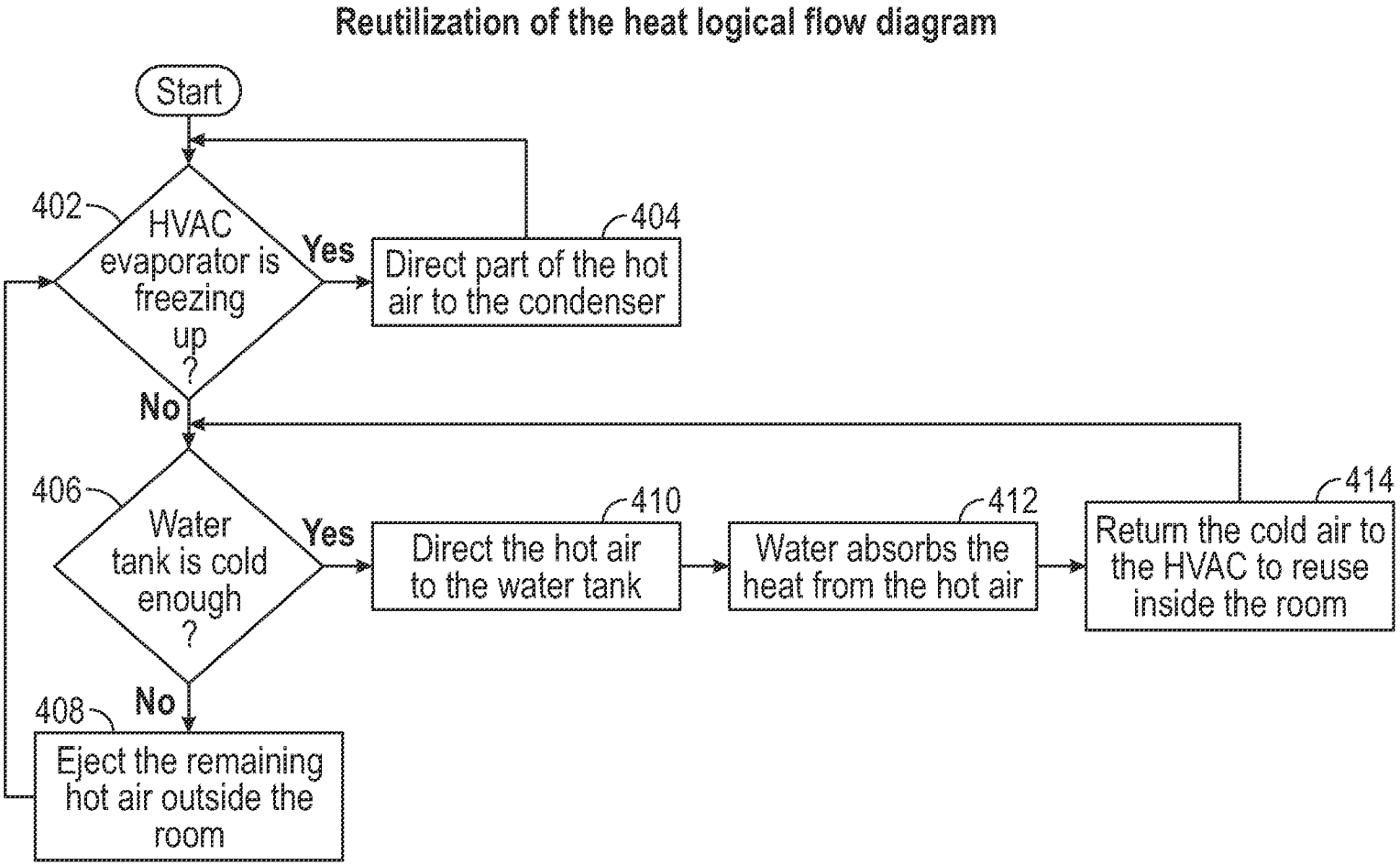
FIG. 4 is a flowchart highlighting an illustrative method for waste heat utilization by the system of FIG. 2B.

FIG. 4 is a flowchart highlighting an illustrative method for waste heat utilization by the system of FIG. 2B. According to some embodiments of the present disclosure, when waste heat utilization is implemented, various aspects of the system may be monitored by controller 105 in conjunction with various sensors. The presently described method is a non-limiting example of how the waste heat may be utilized to improve energy efficiency of various components both internal and external to the system.

During operation of the HVAC unit 10, the evaporator 190 may accumulate ice due to water vapor in the air freezing on and around the coils of the evaporator 190. A sensor associated with the evaporator 190 may provide information to the controller 105 indicating that such icing is occurring (e.g., based on reduced air flow at the evaporator 190, evaporator temperature, etc.) (step 402: Yes). In response, the controller 105 may be configured to adjust the valve 206 to cause at least a portion of the exhaust air to flow from the collection duct 210 through the evaporator duct 222 and across the evaporator 190 (step 404). The valve 206 may be opened fully or may be opened in increments by controller 105 such that varying levels of icing may be addressed without increasing the temperature of the cooled air in the primary duct 100 beyond a threshold temperature (e.g., a temperature providing insufficient cooling for a current thermal load). Based on the waste heat in the exhaust air, icing on the evaporator 190 may be reduced, and the exhaust air cooled for reintroduction into the primary duct 100.

For purposes of the present method discussion, it will be assumed that a supplemental heating system 230 comprises an outdoor container 226 configured to operate as a heat sync and to absorb waste heat and transfer the waste heat to the atmosphere. In such embodiments, water may be implemented as the liquid and a temperature of the water 232 in the container 226 may be monitored to determine whether the temperature is sufficiently low to operate as a heat sync (step 406). When the temperature of the water 232 is above a set threshold temperature (e.g., 15° C.) (step 406: No) the exhaust air may be directed to the exterior of the space 116 (step 408). For example, when controller 105 determines that the temperature of the water is above the threshold temperature (e.g., via a temperature sensor in the container 226), the controller 105 may cause the valve 206' to close such that any exhaust air arriving at the valve 206' may continue to flow to the exterior 218 via the collection duct 210.

When it is determined that the water 232 in the container 226 is below the threshold temperature (e.g., 15° C.), the exhaust air may be directed to the supplemental heating system 230 via the valve 206'. For example, the controller may determine that the temperature of the water 232 is 10° C., and may therefore, open the valve 206' such that the exhaust air in the collection duct 210 is directed to the heat exchanger 225 via the heating duct 224. The controller 105 may adjust the valve 206' to be fully opened such that a maximum amount of exhaust air is directed through the heating duct 224, or alternatively, the controller may adjust the valve 206' to open in increments to allow a defined amount of the exhaust air to flow to the heating duct 224. For example, when the temperature of the water 232 is approaching the threshold temperature (e.g., 15° C.) the controller 105 may partially close the valve 206' to slow the heat transfer at heat exchanger 225 to the water 232 (step 412).

Once the exhaust air has passed through the heat exchanger 225 of supplemental heating system 230, the cooled exhaust air may be directed to the cooled air duct 228, for example, to be returned to the cooled air flow of the HVAC unit 10 (step 414). By returning cooled air to the cool air flow of HVAC unit 10, compressor run time may be further reduced while still providing desirable levels of cooling for the equipment 170.

Figure 5:
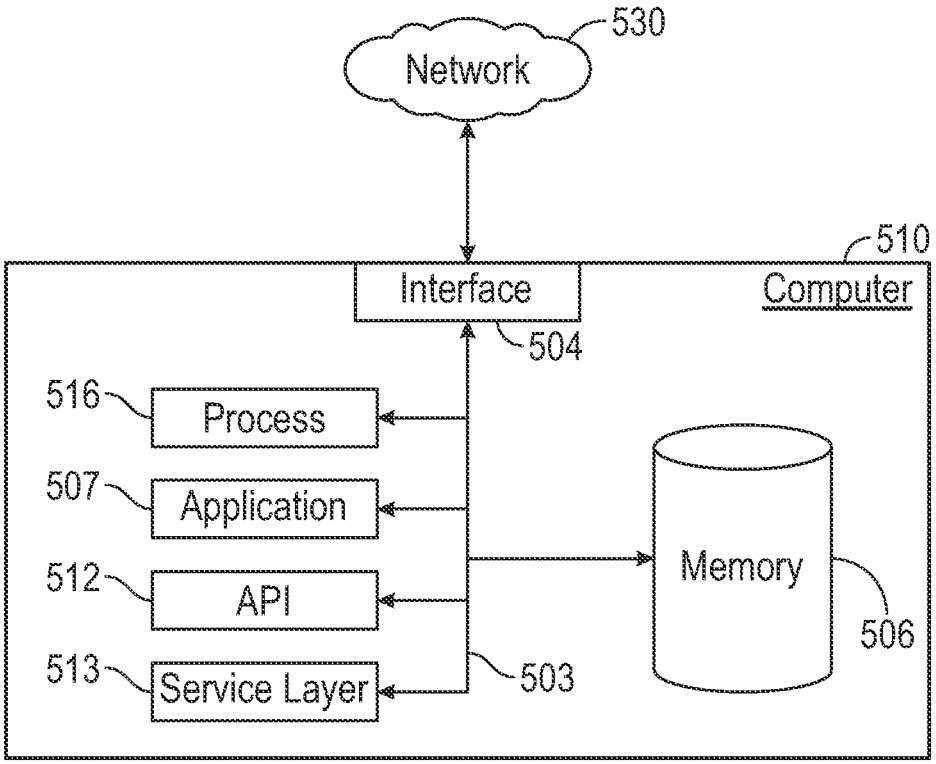
FIG. 5 shows an illustrative computing system that may be implemented as one or more components of the system of FIGS. 1A-1B.

FIG. 5 is a block diagram of a computer 510 used to provide computational functionalities associated with described algorithms, methods, functions, processes, flows, and procedures as described in the instant disclosure, according to an implementation. The illustrated computer 510 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 510 may include a computer that includes an input device, such as a keypad, keyboard, touch screen, or other device that can accept user information, and an output device that conveys information associated with the operation of the computer 510, including digital data, visual, or audio information (or a combination of information), or a graphical user interface (GUI).

The computer 510 can serve in a role as a client, a network component, a server, a database or other persistency, or any other component (or a combination of roles) of a computer for performing the subject matter described in the instant disclosure. The illustrated computer 510 may be implemented as the controller 105 described above and may perform operations consistent therewith. In some implementations, one or more components of the computer 510 may be configured to operate within environments, including cloud-computing-based, local, global, or other environment (or a combination of environments).

At a high level, the computer 510 is an electronic computing device operable to receive, transmit, process, store, or manage data and information associated with the described subject matter. According to some implementations, the computer 510 may also include or be communicably coupled with an application server, e-mail server, web server, caching server, streaming data server, business intelligence (BI) server, or other server (or a combination of servers).

The computer 510 can receive requests over network 530 from a client application (e.g., executing on another computer 510) and responding to the received requests by processing the said requests in an appropriate software application. In addition, requests may also be sent to the computer 510 from internal users (for example, from a command console or by other appropriate access method), external or third-parties, other automated applications, as well as any other appropriate entities, individuals, systems, or computers.

Each of the components of the computer 510 can communicate using a system bus 503. In some implementations, any or all of the components of the computer 510, both hardware or software (or a combination of hardware and software), may interface with each other or the interface 504 (or a combination of both) over the system bus 503 using an application programming interface (API) 512 or a service layer 513 (or a combination of the API 512 and service layer 513. The API 512 may include specifications for routines, data structures, and object classes. The API 512 may be either computer-language independent or dependent and refer to a complete interface, a single function, or even a set of APIs. The service layer 513 provides software services to the computer 510 or other components (whether or not illustrated) that are communicably coupled to the computer 510.

The functionality of the computer 510 may be accessible for all service consumers using this service layer. Software services, such as those provided by the service layer 513, provide reusable, defined business functionalities through a defined interface. For example, the interface may be software written in JAVA, C++, or other suitable language providing data in extensible markup language (XML) format or another suitable format. While illustrated as an integrated component of the computer 510, alternative implementations may illustrate the API 512 or the service layer 513 as stand-alone components in relation to other components of the computer 510 or other components (whether or not illustrated) that are communicably coupled to the computer 510. Moreover, any or all parts of the API 512 or the service layer 513 may be implemented as child or sub-modules of another software module, enterprise application, or hardware module without departing from the scope of this disclosure.

The computer 510 includes an interface 504. Although illustrated as a single interface 504 in FIG. 5, two or more interfaces 504 may be used according to particular desires or implementations of the computer 510. The interface 504 is used by the computer 510 for communicating with other systems in a distributed environment that are connected to the network 530. Generally, the interface 504 includes logic encoded in software or hardware (or a combination of software and hardware) and operable to communicate with the network 530. More specifically, the interface 504 may include software supporting one or more communication protocols associated with communications such that the network 530 or interface's hardware is operable to communicate physical signals within and outside of the illustrated computer 510.

The computer 510 includes at least one computer processor 516. Although illustrated as a single computer processor 516 in FIG. 5, two or more processors may be used according to particular desires or particular implementations of the computer 510. Generally, the computer processor 516 executes instructions and manipulates data to perform the operations of the computer 510 and any algorithms, methods, functions, processes, flows, and procedures as described in the instant disclosure.

The computer 510 also includes a memory 506 that holds data for the computer 510 or other components (or a combination of both) that can be connected to the network 530. For example, memory 506 may include a database storing data (e.g., log files) and/or processing instructions consistent with this disclosure. Although illustrated as a single memory 506 in FIG. 5, two or more memories may be used according to implementations of the computer 510 and the described functionality. While memory 506 is illustrated as an integral component of the computer 510, in alternative implementations, memory 506 can be external to the computer 510.

The application 507 is an algorithmic software engine providing functionality according to implementations of the computer 510, particularly with respect to functionality described in this disclosure. For example, application 507 can serve as one or more components, modules, applications, etc. configured to cause the computer 510 to function as the controller 105 (e.g., monitoring temperature and/or motion within the space 116). Further, although illustrated as a single application 507, the application 507 may be implemented as multiple applications 507 on the computer 510. In addition, although illustrated as integral to the computer 510, in alternative implementations, the application 507 can be external to the computer 510.

There may be any number of computers 510 associated with, or external to, a computer system containing computer 510, each computer 510 communicating over network 530. Further, the term "client," "user," and other appropriate terminology may be used interchangeably as appropriate without departing from the scope of this disclosure. Moreover, this disclosure contemplates that many users may use one computer 510, or that one user may use multiple computers 510.

One or more of the embodiments of the present disclosure may be described as in the following clauses:

Clause 1. A system for cooling a plurality of devices of a multi-position rack, the system comprising: a heating, ventilation, and air conditioning (HVAC) unit configured to generate a flow of cooled air; a plurality of sub-ducts, each sub-duct of the plurality of sub-ducts being configured to direct a portion of the flow of cooled air to a respective device of the plurality of devices in the multi-position rack; and a primary duct configured to direct the flow of cooled air away from the HVAC unit to the plurality of sub-ducts, wherein each sub-duct of the plurality of sub-ducts is sized according to a thermal output corresponding to a respective device of the plurality of devices.

Clause 2. The system according to clause 1, wherein the thermal output corresponds to a maximal thermal output of a respective device of the plurality of devices.

Clause 3. The system of any of clauses 1-2, further comprising one or more controllable dampers, each of the one or more controllable dampers corresponding to a respective sub-duct of the plurality of sub-ducts, the one or more controllable dampers being configured to control the flow of cooled air.

Clause 4. The system of clause 3, comprising a controller configured to monitor operating characteristics of the one or more devices and to control the one or more controllable dampers based on the operating characteristics.

Clause 5. The system of clause 4, wherein the operating characteristics comprise one or more of an actual temperature of one or more of the plurality of devices, a fan speed of one or more of the plurality of devices, and an actual power consumption of one or more of the plurality of devices.

Clause 6. The system of clause 4, wherein the controller is configured to control the one or more controllable dampers based on a threshold temperature being reached by one or more of the plurality of devices, wherein the threshold temperature is operator configured.

Clause 7. The system of any of clauses 1-6, further comprising: a sensor configured to provide information regarding one or more of entry of a human into a space in which the multi-position rack is present and exit of a human from the space; and a secondary cooling duct configured to provide a second portion of cooled air to the space in which the multi-position rack is present in response to entry of the human into the space.

Clause 8. The system of clause 7, comprising: a controller; and a damper arranged within the secondary cooling duct, wherein the controller is configured to cause the damper to open in response to determining entry of a human into the space.

Clause 9. The system of any of clauses 1-8, wherein each sub-duct of the plurality of sub-ducts comprises an outlet sized according to the thermal output of a device of the plurality of devices to which it corresponds.

Clause 10. The system of any of clauses 1-9, wherein the HVAC unit is configured to adjust a temperature of the flow of cooled air based on an overall thermal load.

Clause 11. The system of any of clauses 4-10, further comprising: a humidity sensor configured to provide information related to an ambient humidity surrounding the multi-position rack; wherein the controller is further configured to control the one or more controllable dampers based on the ambient humidity.

Clause 12. The system of any of clauses 4-11, wherein one or more of the plurality of sub-ducts is movable, and wherein the controller is configured to cause a movable sub-duct to move in response to a temperature event associated with one or more of the plurality of devices.

Clause 13. The system of any of clauses 4-12, wherein the controller is communicatively linked to a power supply associated with one or more of the plurality of devices, and wherein the controller is configured to terminate power for one or more of the plurality of devices in response to a temperature event associated with one or more of the plurality of devices.

Clause 14. The system of any of clauses 4-13, wherein the controller is configured to monitor a temperature history of one or more of the plurality of devices and to train a machine learning model based on the temperature history to produce a trained machine learning model.

Clause 15. A system for collecting waste heat from a plurality of devices of a multi-position rack, the system comprising: a plurality of exhaust ducts, each exhaust duct of the plurality of exhaust ducts being configured to receive exhaust air that has been passed over a respective device of the plurality of devices in the multi-position rack, wherein each exhaust duct is sized according to a thermal output corresponding to the respective device; and a collection duct configured to receive exhaust air from each exhaust duct of the plurality of exhaust ducts and to direct the exhaust air to a distribution hub, wherein the distribution hub is configured to control a flow of the exhaust air to one or more of a heat exchanger and an exterior exhaust vent.

Clause 16. The system of clause 15, wherein the heat exchanger is configured to provide heated water to one or more of a sanitary hot water system, a heating system, and a power generation system.

Clause 17. The system of any of clauses 15-16, wherein the exterior exhaust vent is located at a position exterior to an enclosed space in which the multi-position rack is located.

Clause 18. The system of clause 17, wherein the exterior exhaust vent is configured to provide heat to an inhabited space.

Clause 19. The system of any of clauses 15-18, wherein the heat exchanger comprises an evaporator of an HVAC unit configured to provide cooled air to the plurality of devices.

Clause 20. The system of any of clauses 15-19, wherein exhaust air provided to the heat exchanger is returned to an air intake of the HVAC unit.

Although several example embodiments have been described in detail above, those skilled in the art will readily appreciate that many modifications are possible in the example embodiments without materially departing from this invention. For example, the system can be integrated with an electrical distribution panel associated with the space 116 (e.g., main power supply) such that if one or more pieces of equipment 170 exceed an absolute maximum temperature associated with a respective piece of equipment 170, the system will trigger the electrical distribution panel to cut off the power for the one or more pieces of equipment 170 exceeding the absolute maximum temperature. This can protect the equipment 170 from damage or even destruction from an overheat situation. Additionally, the system may request operator approval prior to triggering the electrical distribution panel to cut power, e.g., via a temperature warning sent by controller 105.

Accordingly, all such modifications are intended to be included within the scope of this disclosure as defined in the following claims.

What is claimed:

1. A system comprising:

a heating, ventilation, and air conditioning (HVAC) unit configured to generate a flow of cooled air;

a plurality of sub-ducts, each sub-duct of the plurality of sub-ducts being configured to direct a portion of the flow of cooled air to a respective device of a plurality of devices in a multi-position rack;

a primary duct connected to the plurality of sub-ducts, wherein the primary duct is configured to direct the flow of cooled air away from the HVAC unit to the plurality of sub-ducts, a plurality of controllable dampers corresponding to the plurality of sub-ducts, wherein a respective controllable damper among the plurality of controllable dampers is configured to control the portion of the flow of cooled air to a respective sub-duct among the plurality of sub-ducts;

a controller communicatively connected to the plurality of controllable dampers, wherein the controller is configured to monitor a plurality of operating characteristics of the plurality of devices and to control the plurality of controllable dampers based on the plurality of operating characteristics; and a humidity sensor connected to the controller, wherein the humidity sensor is configured to provide information related to an ambient humidity surrounding the multi-position rack, wherein the controller is further configured to control the plurality of controllable dampers based on the ambient humidity, wherein the plurality of sub-ducts are movable, and wherein the controller is further configured to cause the respective sub-duct to move in response to a temperature event associated with at least one of the plurality of devices.

2. The system of claim 1, wherein the plurality of operating characteristics comprise one or more of an actual temperature of one or more of the plurality of devices, a fan speed of one or more of the plurality of devices, and an actual power consumption of one or more of the plurality of devices.

3. The system of claim 1, wherein the controller is configured to control the plurality of controllable dampers based on a threshold temperature being reached by one or more of the plurality of devices, wherein the threshold temperature is operator configured.

4. The system of claim 1, further comprising:

a sensor configured to provide information regarding one or more of entry of a human into a space in which the multi-position rack is present and exit of a human from the space; and a secondary cooling duct configured to provide a second portion of cooled air to the space in which the multi-position rack is present in response to entry of the human into the space.

5. The system of claim 4, comprising:

a controller; and a damper arranged within the secondary cooling duct, wherein the controller is configured to cause the damper to open in response to determining entry of a human into the space.

6. The system of claim 1, wherein the HVAC unit is configured to adjust a temperature of the flow of cooled air based on an overall thermal load.

7. The system of claim 1, wherein the controller is communicatively linked to a power supply associated with one or more of the plurality of devices, and wherein the controller is configured to terminate power for one or more of the plurality of devices in response to a temperature event associated with one or more of the plurality of devices.

8. The system of claim 1, wherein the controller is configured to monitor a temperature history of one or more of the plurality of devices and to train a machine learning model based on the temperature history to produce a trained machine learning model.

9. The system of claim 1, further comprising:

a plurality of exhaust ducts, each exhaust duct of the plurality of exhaust ducts being configured to receive exhaust air that has been passed over a respective device of the plurality of devices in the multi-position rack, wherein each exhaust duct of the plurality of exhaust ducts is sized according to a thermal output corresponding to the respective device; and a collection duct configured to receive exhaust air from each exhaust duct of the plurality of exhaust ducts and to direct the exhaust air to a distribution hub, wherein the distribution hub is configured to control a flow of the exhaust air to one or more of a heat exchanger and an exterior exhaust vent.

10. The system of claim 9, wherein the heat exchanger is configured to provide heated water to one or more of a sanitary hot water system, a heating system, and a power generation system.

11. The system of claim 9, wherein the exterior exhaust vent is located at a position exterior to an enclosed space in which the multi-position rack is located.

12. The system of claim 11, wherein the exterior exhaust vent is configured to provide heat to an inhabited space.

13. The system of claim 9, wherein the heat exchanger comprises an evaporator of the HVAC unit configured to provide cooled air to the plurality of devices.

14. The system of claim 9, wherein exhaust air provided to the heat exchanger is returned to an air intake of the HVAC unit.

* * * * *